US005967362A

United States Patent [19]

Corbin

[11] Patent Number: 5,967,362

[45] Date of Patent: Oct. 19, 1999

[54] GARBAGE CAN WITH LIFTING SUPPORTS

[76] Inventor: Donald E. Corbin, P.O. Box 3036, Globe, Ariz. 85501

[21] Appl. No.: 09/078,634

[22] Filed: May 14, 1998

[51] Int. Cl.[6] ..... B65D 25/28

[52] U.S. Cl. ..... 220/758; 220/772; 220/676; 220/648

[58] Field of Search ..... 220/755, 758, 220/772, 648, 649, 676

[56] References Cited

U.S. PATENT DOCUMENTS

| | | | |
|---|---|---|---|
| 994,771 | 6/1911 | Moore | 220/772 |
| 2,314,835 | 3/1943 | Johns et al. | 220/772 |
| 2,340,486 | 2/1944 | Palmer | 220/772 |
| 3,926,452 | 12/1975 | Goings | 220/772 |
| 4,045,069 | 8/1977 | Fife | 220/772 |
| 5,547,104 | 8/1996 | Parker | 220/772 |

*Primary Examiner*—Joseph M. Moy

[57] ABSTRACT

A new garbage can with lifting supports for reducing an amount of effort needed to lift and empty the garbage can. The inventive device includes a container having an open upper end, a closed lower end, and a side wall therebetween. The open upper end has a lid removably disposed thereover. A pair of lifting supports are coupled with respect to the container. An upper lifting support is disposed downwardly of the open upper end of the container. A lower lifting support is disposed upwardly of the closed lower end of the container.

6 Claims, 3 Drawing Sheets

GARBAGE CAN WITH LIFTING SUPPORTS

BACKGROUND OF THE INVENTION

1 Field of the Invention

The present invention relates to garbage cans and more particularly pertains to a new garbage can with lifting supports for reducing an amount of effort needed to lift and empty the garbage can.

2 Description of the Prior Art

The use of garbage cans is known in the prior art. More specifically, garbage cans heretofore devised and utilized are known to consist basically of familiar, expected and obvious structural configurations, notwithstanding the myriad of designs encompassed by the crowded prior art which have been developed for the fulfillment of countless objectives and requirements.

Known prior art garbage cans include U.S. Pat. No. Des. 334,639 to Kroll; U.S. Pat. No. 5,207,344 to Davies et al.; U.S. Pat. No. Des. 269,643 to Hatrman et al.; U.S. Pat. No. 5,292,023 to Yen; U.S. Pat. No. 4,473,170 to Ciancimino; and U.S. Pat. No. 4,279,357 to Robinson.

While these devices fulfill their respective, particular objectives and requirements, the aforementioned patents do not disclose a new garbage can with lifting supports. The inventive device includes a container having an open upper end, a closed lower end, and a side wall therebetween. The open upper end has a lid removably disposed thereover. A pair of lifting supports are coupled with respect to the container. An upper lifting support is disposed downwardly of the open upper end of the container. A lower lifting support is disposed upwardly of the closed lower end of the container.

In these respects, the garbage can with lifting supports according to the present invention substantially departs from the conventional concepts and designs of the prior art, and in so doing provides an apparatus primarily developed for the purpose of reducing an amount of effort needed to lift and empty the garbage can.

SUMMARY OF THE INVENTION

In view of the foregoing disadvantages inherent in the known types of garbage cans now present in the prior art, the present invention provides a new garbage can with lifting supports construction wherein the same can be utilized for reducing an amount of effort needed to lift and empty the garbage can.

The general purpose of the present invention, which will be described subsequently in greater detail, is to provide a new garbage can with lifting supports apparatus and method which has many of the advantages of the garbage cans mentioned heretofore and many novel features that result in a new garbage can with lifting supports which is not anticipated, rendered obvious, suggested, or even implied by any of the prior art garbage cans, either alone or in any combination thereof.

To attain this, the present invention generally comprises a cylindrical container having an open upper end, a closed lower end, and a cylindrical side wall therebetween. The open upper end has a diameter greater than a diameter of the closed lower end. The open upper end has a lid removably disposed thereover. The cylindrical side wall has a plurality of circumferentially spaced drainage apertures therethrough upwardly of the closed lower end. A pair of lifting supports are coupled with respect to the cylindrical container. An upper lifting support is disposed downwardly of the open upper end of the container. A lower lifting support is disposed upwardly of the closed lower end of the container. The upper lifting support is comprised of a lower circular band extending around the cylindrical side wall. The lower circular band has an angularly disposed extension extending upwardly therefrom. The lower lifting support is comprised of an upper circular band extending around the cylindrical side wall. The upper circular band has an angularly disposed extension extending downwardly therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garbage can with lifting supports apparatus and method which has many of the advantages of the garbage cans mentioned heretofore and many novel features that result in a new garbage can with lifting supports which is not anticipated, rendered obvious, suggested, or even implied by any of the prior art garbage cans, either alone or in any combination thereof.

It is another object of the present invention to provide a new garbage can with lifting supports which may be easily and efficiently manufactured and marketed.

It is a further object of the present invention to provide a new garbage can with lifting supports which is of a durable and reliable construction.

An even further object of the present invention is to provide a new garbage can with lifting supports which is susceptible of a low cost of manufacture with regard to both materials and labor, and which accordingly is then susceptible of low prices of sale to the consuming public, thereby making such garbage can with lifting supports economically available to the buying public.

Still yet another object of the present invention is to provide a new garbage can with lifting supports which provides in the apparatuses and methods of the prior art some of the advantages thereof, while simultaneously overcoming some of the disadvantages normally associated therewith.

Still another object of the present invention is to provide a new garbage can with lifting supports for reducing an amount of effort needed to lift and empty the garbage can.

Yet another object of the present invention is to provide a new garbage can with lifting supports which includes a container having an open upper end, a closed lower end, and a side wall therebetween. The open upper end has a lid removably disposed thereover. A pair of lifting supports are coupled with respect to the container. An upper lifting support is disposed downwardly of the open upper end of the container. A lower lifting support is disposed upwardly of the closed lower end of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
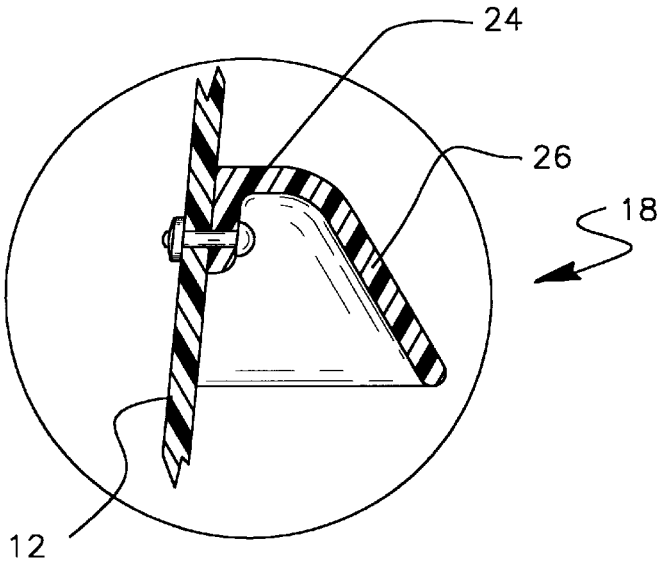
FIG. 2 is a cross-sectional view of the lifting supports of the present invention as taken from circle 2 of FIG. 1.
Figure 1:
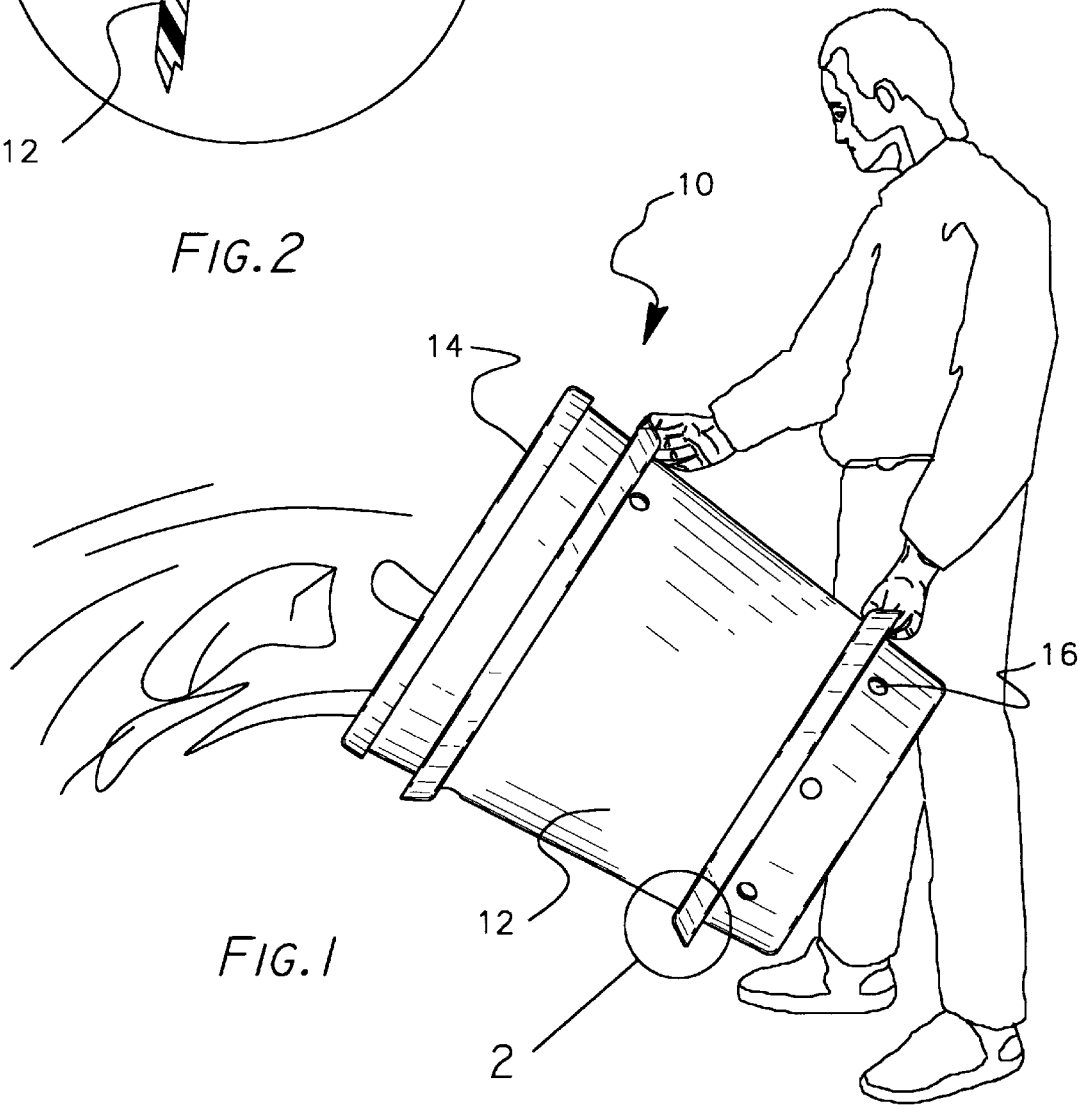
FIG. 1 is a side view of a new garbage can with lifting supports according to the present invention illustrated in use.
Figure 3:
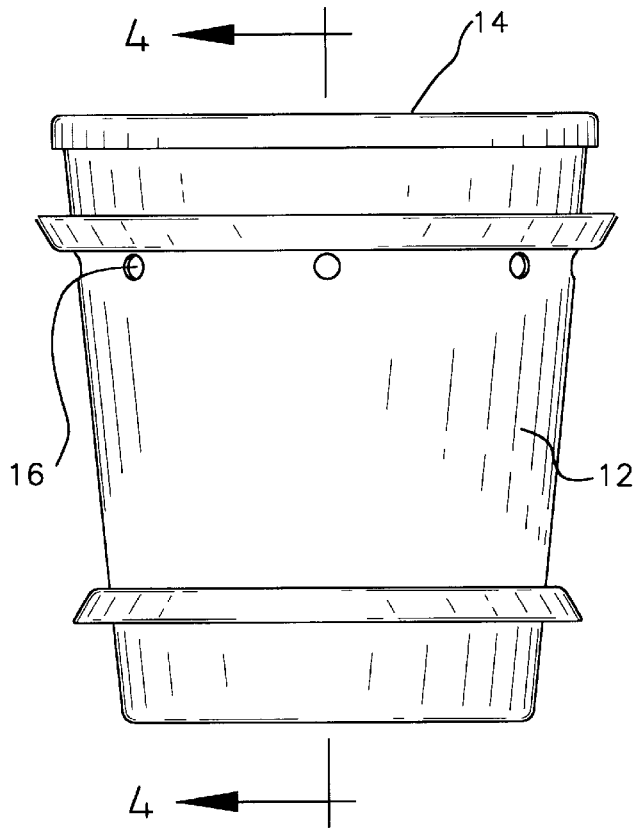
FIG. 3 is a front elevation view of the present invention.
Figure 4:
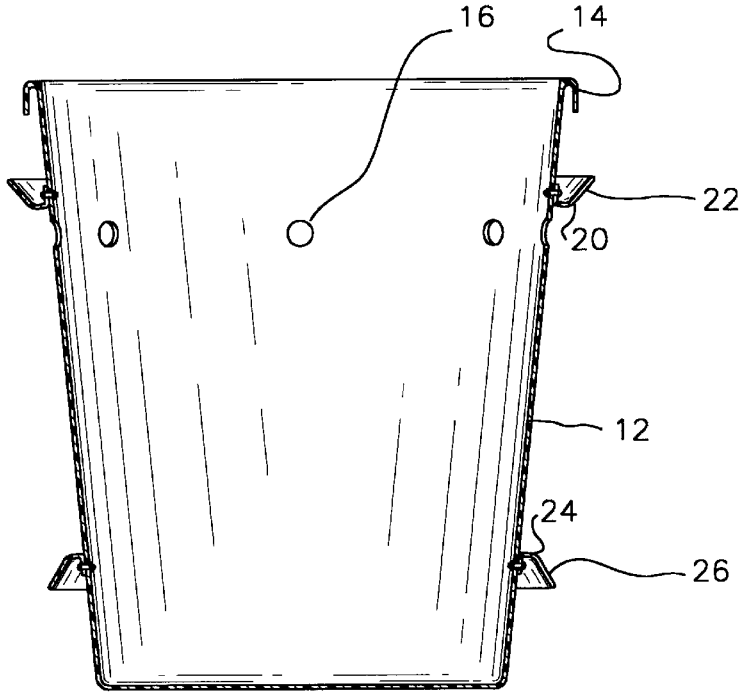
FIG. 4 is a cross-sectional view of the present invention as taken along line 4—4 of FIG. 3.

With reference now to the drawings, and in particular to FIGS. 1 through 6 thereof, a new garbage can with lifting supports embodying the principles and concepts of the present invention and generally designated by the reference numeral 10 will be described.

As best illustrated in FIGS. 1 through 6, the garbage can with lifting supports 10 comprises a cylindrical container 12 having an open upper end, a closed lower end, and a cylindrical side wall therebetween. The open upper end has a diameter greater than a diameter of the closed lower end. The open upper end has a lid 14 removably disposed thereover. The cylindrical side wall has a plurality of circumferentially spaced drainage apertures 16 therethrough upwardly of the closed lower end.

A pair of lifting supports 18 are coupled with respect to the cylindrical container. An upper lifting support is disposed downwardly of the open upper end of the container 12. A lower lifting support is disposed upwardly of the closed lower end of the container 12. The upper lifting support is comprised of a lower circular band 20 extending around the cylindrical side wall. The lower circular band 20 has an angularly disposed extension 22 extending upwardly therefrom. The lower lifting support is comprised of an upper circular band 24 extending around the cylindrical side wall. The upper circular band 24 has an angularly disposed extension 26 extending downwardly therefrom.

Figure 5:
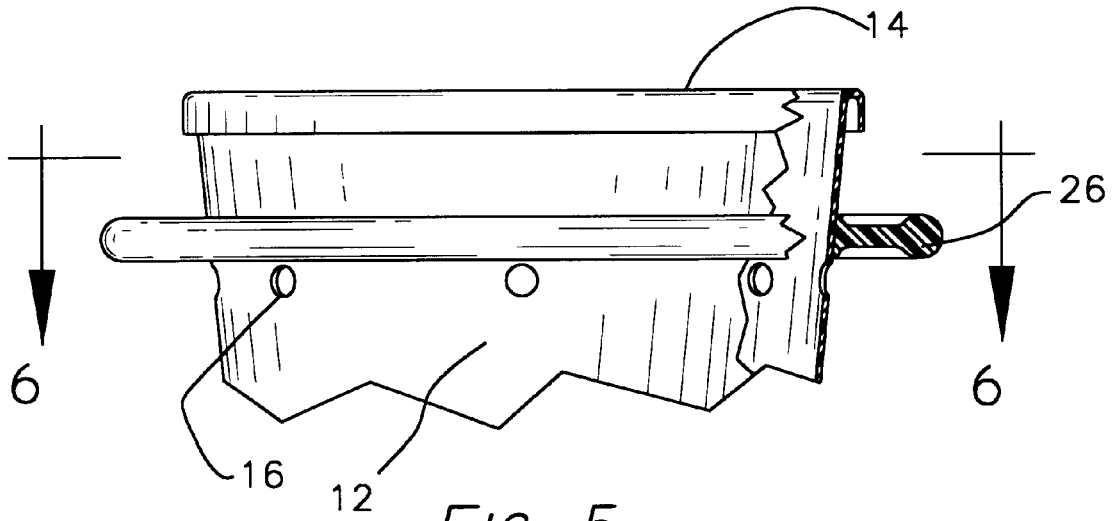
FIG. 5 is a sectional view of an alternate embodiment of the present invention.
Figure 6:
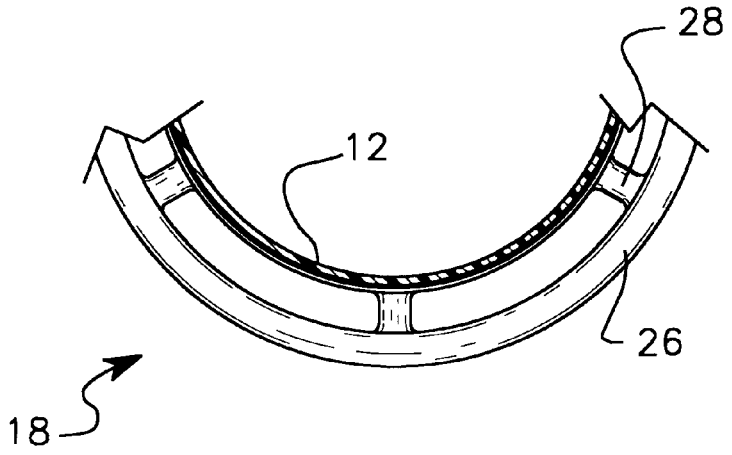
FIG. 6 is a cross-sectional view of the present invention as taken along line 6—6 of FIG. 5.

FIGS. 5 and 6 illustrate an alternate embodiment of the present invention. In this embodiment, the pair of lifting supports 18 are comprised of a circular ring 26 that encircles the container 12. The circular ring 26 includes a plurality of inwardly extending supports 28 that secure the circular ring 26 to the container 12.

In use, the present invention would provide the user with a firm grip for ease in lifting and transporting the container 12. The present invention would prevent excessive back and neck strain when lifting cans heavily laden with garbage. The lifting supports 18 on the container 12 would allow the user to lift the container 12 without touching the inside or the bottom. The lifting supports 18 would also protect the user from cuts, injuries, and bites. In addition, the lifting supports 18 would provide an equal balance on the top and the bottom of the container 12 to prevent spillage. The drainage apertures 16 are incorporated into the container 12 to prevent water from accumulating inside the container 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new garbage can with lifting supports for reducing an amount of effort needed to lift and empty the garbage can comprising, in combination:

a cylindrical container having an open upper end, a closed lower end, and a cylindrical side wall therebetween, the open upper end having a diameter greater than a diameter of the closed lower end, the open upper end having a lid removably disposed thereover, the cylindrical side wall having a plurality of circumferentially spaced drainage apertures therethrough upwardly of the closed lower end; and a pair of lifting supports coupled with respect to the cylindrical container, an upper lifting support disposed downwardly of the open upper end of the container, a lower lifting support disposed upwardly of the closed lower end of the container, the upper lifting support comprised of a lower circular band extending around the cylindrical side wall, the lower circular band having an angularly disposed extension extending upwardly therefrom, the lower lifting support comprised of an upper circular band extending around the cylindrical side wall, the upper circular band having an angularly disposed extension extending downwardly therefrom.

2. A new garbage can with lifting supports for reducing an amount of effort needed to lift and empty the garbage can comprising, in combination:

a container having an open upper end, a closed lower end, and a side wall therebetween, the open upper end having a lid removably disposed thereover; and a pair of lifting supports coupled with respect to the container, an upper lifting support disposed downwardly of the open upper end of the container, a lower lifting support disposed upwardly of the closed lower end of the container.

3. The garbage can with lifting supports as set forth in claim 2 wherein the open upper end of the container has a diameter greater than a diameter of the closed lower end.

4. The garbage can with lifting supports as set forth in claim 2 wherein the side wall has a plurality of circumferentially spaced drainage apertures therethrough upwardly of the closed lower end.

5. The garbage can with lifting supports as set forth in claim 2 wherein the upper lifting support is comprised of a lower circular band extending around the cylindrical side wall, the lower circular band having an angularly disposed extension extending upwardly therefrom, the lower lifting support comprised of an upper circular band extending around the cylindrical side wall, the upper circular band having an angularly disposed extension extending downwardly therefrom.

6. The garbage can with lifting supports as set forth in claim 2 wherein the upper lifting support is comprised of a circular ring positioned around the container, the circular ring has a plurality of supports extending inwardly therefrom for securement to the container, the lower lifting support is comprised of a circular ring positioned around the container, the circular ring has a plurality of supports extending inwardly therefrom for securement to the container.

* * * * *